US006216487B1

(12) United States Patent
Gano, III

(10) Patent No.: US 6,216,487 B1
(45) Date of Patent: Apr. 17, 2001

(54) RE-FREEZABLE BEVERAGE COOLER

(76) Inventor: John Henry Gano, III, 170 Windview Pl., Alpharetta, GA (US) 30005

( * ) Notice: Subject to any disclaimer, the term of this patent is extended or adjusted under 35 U.S.C. 154(b) by 0 days.

(21) Appl. No.: 09/409,319

(22) Filed: Sep. 30, 1999

(51) Int. Cl.[7] ..... F25D 3/08
(52) U.S. Cl. ..... 62/457.5; 62/530
(58) Field of Search ..... 62/457.5, 530

(56) References Cited

U.S. PATENT DOCUMENTS

| | | | | |
|---|---|---|---|---|
| D. 293,851 | | 1/1988 | Cannon et al. | D3/37 |
| D. 330,631 | | 11/1992 | Ledbetter | D3/37 |
| 3,262,283 | * | 7/1966 | Taylor | 62/457.5 |
| 4,295,345 | | 10/1981 | Atkinson | 62/371 |
| 4,324,111 | * | 4/1982 | Edwards | 62/457 |
| 4,516,409 | | 5/1985 | Hobbs, Jr. et al. | 62/457 |
| 4,741,176 | | 5/1988 | Johnson et al. | 62/457 |
| 4,989,767 | | 2/1991 | Buschbom | 224/274 |
| 5,007,250 | * | 4/1991 | Musielak | 62/372 |
| 5,365,739 | * | 11/1994 | Fetterly | 62/3.62 |
| 5,490,396 | * | 2/1996 | Morris | 62/457.2 |
| 5,582,028 | * | 12/1996 | Rilling et al. | 62/530 |
| 5,595,069 | * | 1/1997 | Gies | 62/530 |
| 5,887,437 | * | 3/1999 | Maxim | 62/4 |
| 5,931,005 | * | 8/1999 | Garrett et al. | 62/86 |
| 6,067,816 | * | 5/2000 | Hodosh | 62/457.4 |

* cited by examiner

*Primary Examiner*—William Doerrler
*Assistant Examiner*—Mark S. Shulman
(74) *Attorney, Agent, or Firm*—James W. Kayden; Thomas, Kayden, Horstemeyer & Risley

(57) ABSTRACT

A preferred embodiment of the present invention incorporates an outer shell defining an interior and includes at least one opening for providing access to the interior. Preferably, a cap is provided for engaging the opening so that the cap and the outer shell can encase the interior. Within the interior, at least one storage chamber is formed which is adapted to receive at least one beverage container. Preferably, an insulating material is disposed within the interior between the storage chamber and the outer shell, and a re-freezable material is disposed within the interior between the storage chamber and the insulating material.

6 Claims, 3 Drawing Sheets

RE-FREEZABLE BEVERAGE COOLER

BACKGROUND OF THE INVENTION

1. Field of the Invention

The present invention generally relates to beverage coolers and, in particular, to refreezable coolers which are configured to receive and store canned and/or bottled beverages.

2. Description of the Related Art

Oftentimes, it is desirable to transport beverages in a portable container or cooler so that convenient access to the beverages is provided, such as while playing golf, attending sporting events, going to a beach, etc. Hereinbefore, such a container typically has been formed of either insulating material, for maintaining the temperature of previously chilled beverages, or a combination of insulating material and cooling material, such as blue ice, for instance, whereby the cooling material chills a beverage stored within the container and the insulating material tends to maintain the temperature of both the cooling material and the chilled beverages.

For example, U.S. Pat. No. 4,741,176, issued to Johnson, et al., discloses a beverage cooler, which includes a cylindrical freezer-pack insert to be placed into a cup, and a cover. In an embodiment of the Johnson device, the cylindrical freezer-pack insert includes removable sections to change its size, and removable plugs for putting coolant fluid into the removable sections. Since, however, the Johnson device is adapted for inserting within an individual cup, the device is limited for use in cooling one beverage at a time.

As another example, U.S. Pat. No. 4,295,345, issued to Atkinson, discloses a cooling container for canned beverages. The Atkinson device includes a reusable concave container for carrying and cooling canned beverages having a bottom section containing a plurality of cylindrical compartments, a top section containing corresponding compartments having a slow warming cooling gel in the upper end thereof, and a shoulder strap for carrying the container. While it is apparent that the Atkinson device addresses the problem of cooling multiple beverages simultaneously, it does not, however, provide for increased cooling efficiency of the beverages stored therein, as the cooling gel is stored only in the upper end of the container.

Therefore, there is a need for improved beverage coolers which address these and other shortcomings of the prior art.

BRIEF SUMMARY OF THE INVENTION

Briefly stated the present invention is directed to beverage coolers for transporting and cooling beverage containers. In a preferred embodiment, the cooler incorporates an outer shell defining an interior and includes at least one opening for providing access to the interior. Preferably, a cap is provided for engaging the opening so that the cap and the outer shell can encase the interior. Within the interior, at least one storage chamber is formed which is adapted to receive at least one beverage container. Preferably, an insulating material is disposed within the interior between the storage chamber and the outer shell, and a re-freezable material is disposed within the interior between the storage chamber and the insulating material.

In accordance with another aspect of the present invention, the cooler can incorporate at least two of the storage chambers, with the re-freezable material being arranged to fill interstices formed between the storage chambers.

In accordance with another aspect of the present invention, the re-freezable material is arranged adjacent the upper surface and the side walls of the outer shell.

Other objects, features and advantages of the present invention will become apparent upon reading the following specification, when taken in conjunction with the accompanying drawings.

BRIEF DESCRIPTION OF THE SEVERAL VIEW OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Figure 1:
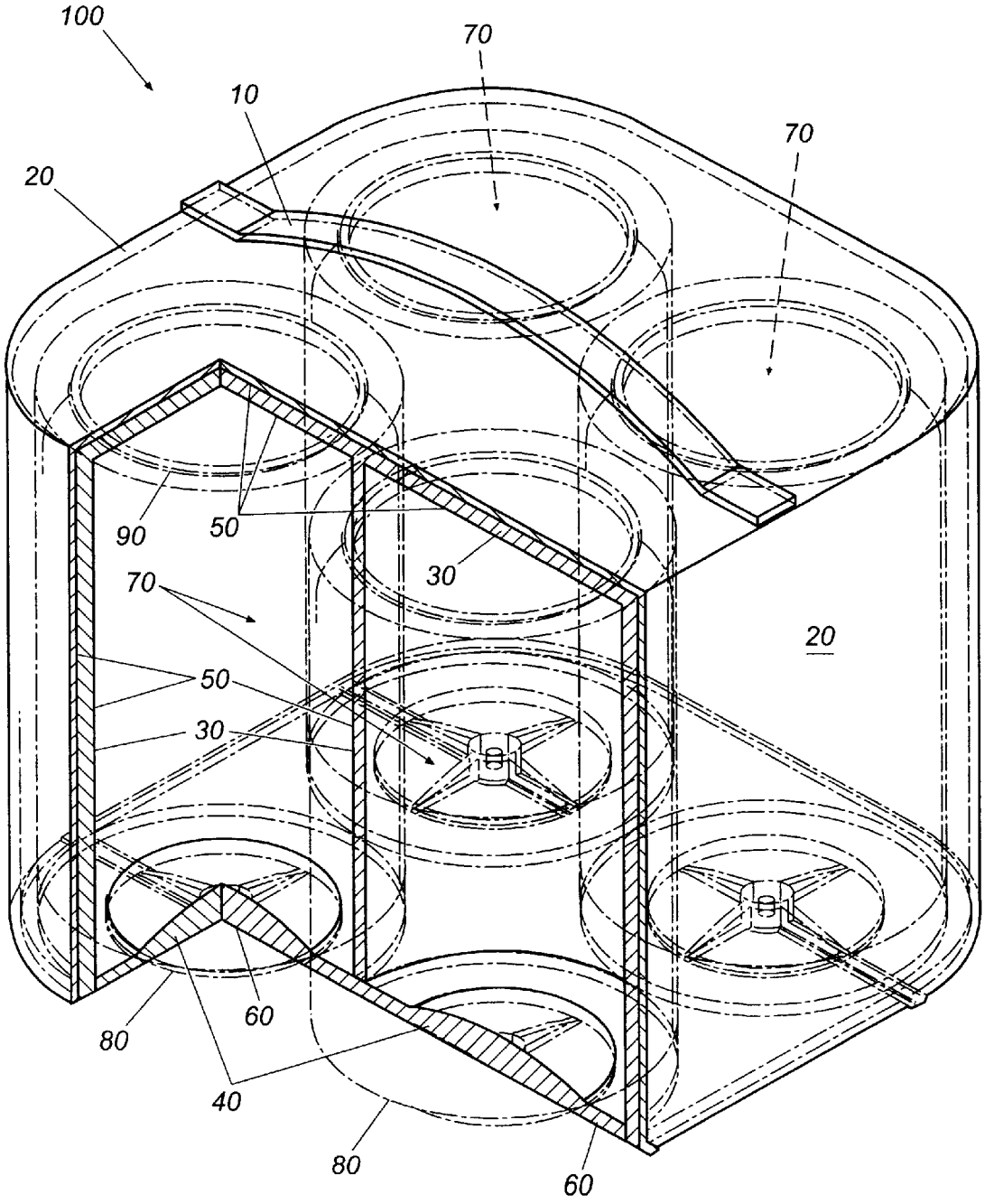
FIG. 1 is a partially cut-away perspective view of a preferred embodiment of the present invention with representative beverage containers shown in phantom lines.
Figure 2:
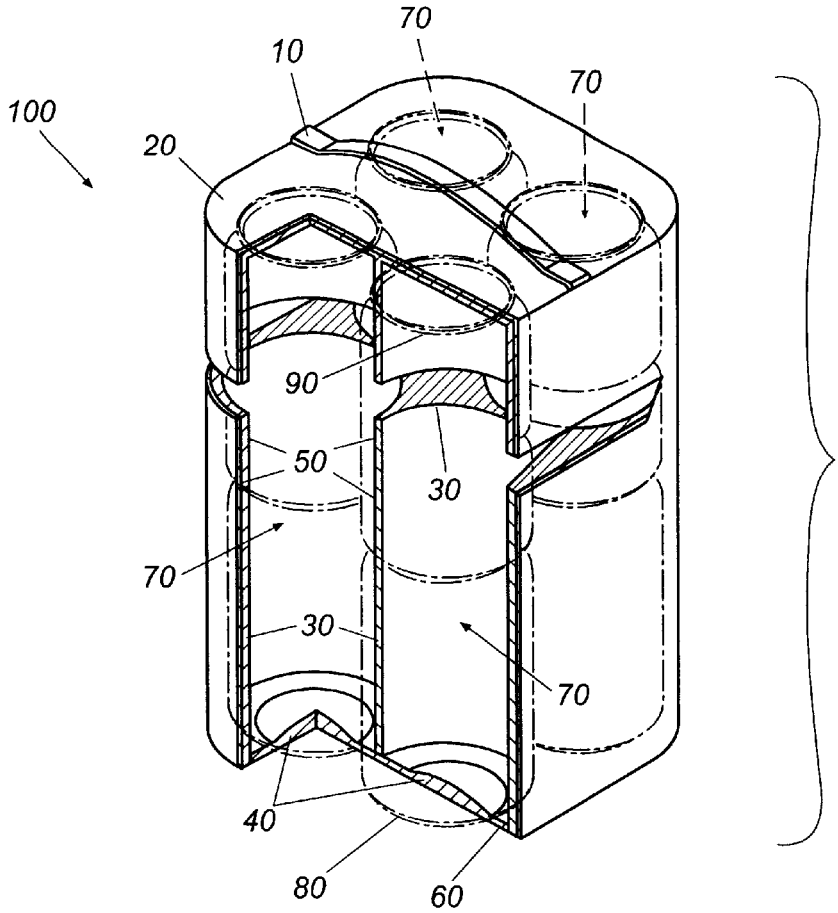
FIG. 2 is a partial cut-away perspective view of an alternative embodiment of the present invention with representative beverage containers shown in phantom lines.
Figure 3:
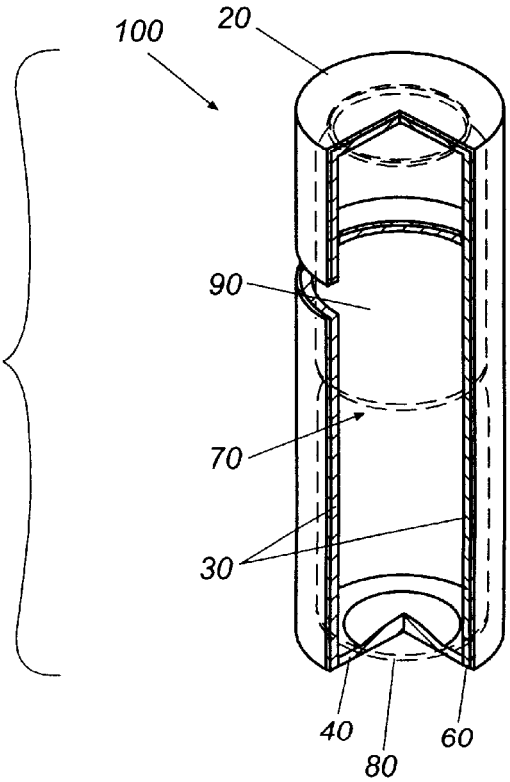
FIG. 3 is a partial cut-away perspective view of an alternative embodiment of the present invention with representative beverage containers shown in phantom lines.
Figure 4:
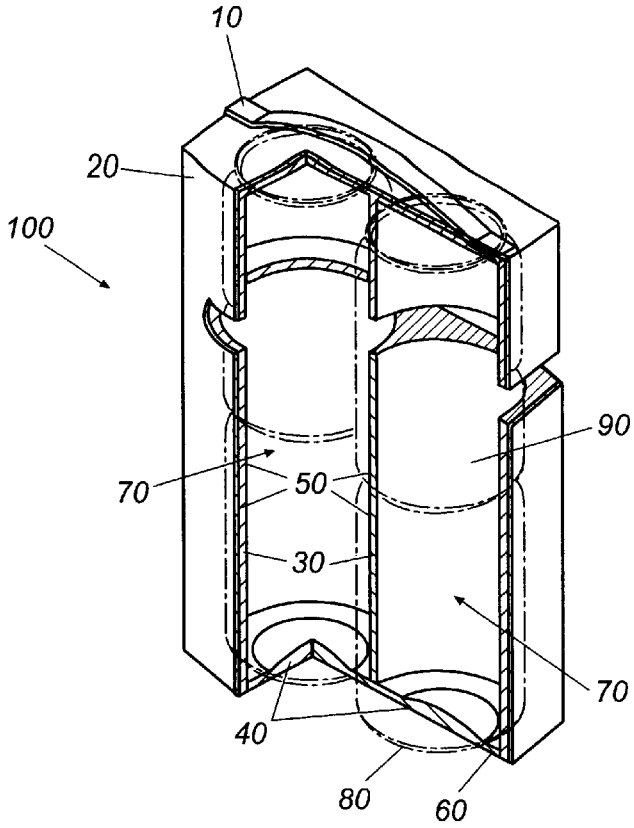
FIG. 4 is a partial cut-away perspective view of an alternative embodiment of the present invention with representative beverage containers shown in phantom lines.
Figure 5:
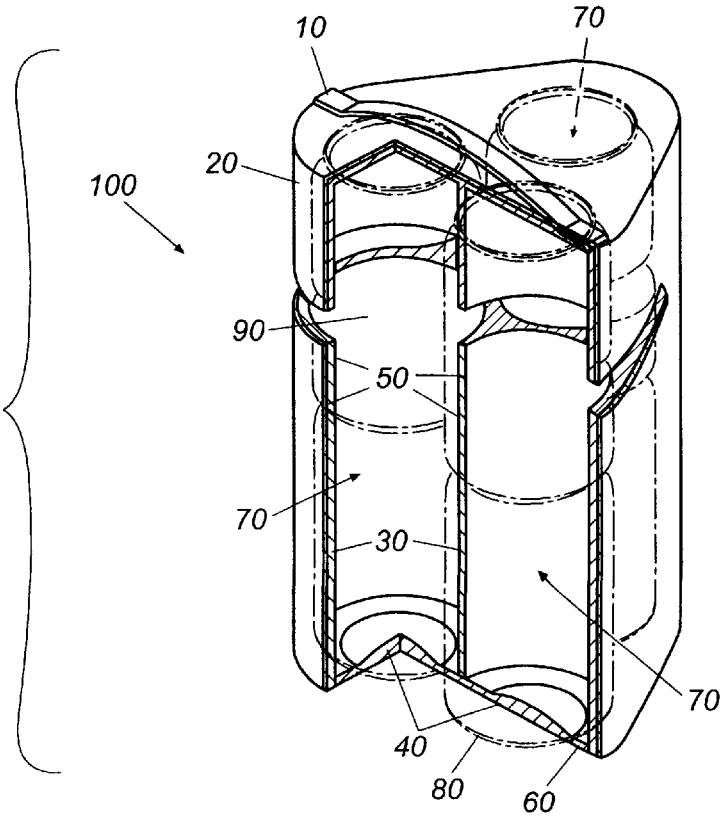
FIG. 5 is a partial cut-away perspective view of an alternative embodiment of the present invention with representative beverage containers shown in phantom lines.

Reference will now be made in detail to the drawings, wherein like reference numerals indicate like parts throughout the several views. As shown in FIG. 1, a preferred embodiment of the cooler 100 of the present invention incorporates an outer shell 20, preferably formed of a durable material, such as molded plastic, or other suitable materials, and which defines an interior. Preferably, one or more storage chambers 70 are provided within the interior. Storage chambers 70 preferably are adapted to receive one or more beverage containers 90, such as conventional cans or bottles, with the cooler being constructed so as to chill the beverages containers 90, and/or maintain the beverages of the containers 90 at a suitable chilled temperature, as described hereinafter.

Access to the storage chamber(s) 70, such as for the insertion and/or removal of beverage containers 90, preferably is facilitated by one or more caps 80 which removably engage the shell 20. For example, in the preferred embodiment depicted in FIG. 1, a plurality of caps 80 are provided along a lower surface of the shell 20, with each of the caps being constructed as a "screw-off" cap so that engagement of each of the caps with the shell is facilitated by rotating the cap relative to the shell. However, in other embodiments, engagement of the cap and shell may be facilitated by a friction fit, or other suitable means.

Preferably, storage chamber(s) 70 are defined by inner walls of a re-freezable material chamber 50 which is adapted to receive and retain a quantity of re-freezable material 30. Preferably, the re-freezable material chamber 50 is adapted to conform to the exterior surface of a beverage container 90 and, therefore, fills the interstices formed between the various containers. Preferably, in embodiments which are adapted for receiving one beverage container within each storage chamber, each beverage container is surrounded and engaged by the inner wall of the re-freezable material chamber, i.e., on all of its sides and its top.

An insulation chamber 40 preferably is provided between the re-freezable material chamber 50 and the shell 20. Preferably, insulation chamber 40 is filled with an efficient insulating material 60, such as polyurethane foam or other suitable material. So configured, each beverage container inserted within a storage chamber 70 is encased by a layer of re-freezable material, as well as within a layer of insulation for maintaining the temperature of the re-freezable material at a suitable temperature.

Additionally, cooler 100 may be provided with a handle 10 so that the cooler is easily transportable. The handle may be formed of numerous suitable materials, such as plastic or leather, for instance, and may be fastened to the cooler in any conventional manner so that the weight of the cooler and any beverage container stored therein does not cause the handle to separate and detach from the shell 20.

As depicted in FIGS. 2–5, various numbers and arrangements of storage containers 70 may be provided for storing and cooling various numbers of beverage containers 90.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

What is claimed is:

1. A beverage cooler for transporting and cooling beverage containers, each of the beverage containers having a substantially cylindrical exterior, said cooler comprising:

an outer shell defining an interior and having at least one opening for providing access to said interior, said outer shell being formed of a substantially rigid material for protecting beverage containers stored therein;

a cap configured to engage said opening, said cap being formed of a substantially rigid material, said cap being movable between an open position and a closed position, in said closed position said cap engaging said at least one opening such that said cap and said outer shell encase said interior for protecting beverage containers stored therein;

at least one storage chamber formed within said interior and communicating with said at least one opening, said storage chamber being configured with a substantially cylindrical shape, said storage chamber adapted to receive at least one beverage container such that said cylindrical shape of said storage chamber substantially conforms to the exterior of a beverage container inserted therein;

an insulating material disposed within said interior between said storage chamber and said outer shell; and a re-freezable material disposed within said interior between said storage chamber and said insulating material such that said re-freezable material is disposed and is configured to conform about the exterior of a beverage container inserted within said storage chamber.

2. The cooler of claim 1, wherein said cooler has at least two of said storage chambers, at least two of said openings, and at least two of said caps, a first of said storage chambers being arranged in a side-by-side relationship with a second of said storage chambers, a first of said openings communicating with said first of said storage chambers, a second of said openings communicating with said second of said storage chambers, a first of said caps for engaging said first of said openings, a second of said caps for engaging said second of said openings, said re-freezable material being arranged to fill interstices formed between said first and second storage chambers.

3. The cooler of claim 1, wherein said outer shell has a lower surface, an upper surface and side walls extending therebetween, said lower surface defining said opening such that said cap is configured to engage said outer shell at said lower surface.

4. The cooler of claim 3, wherein said re-freezable material is arranged adjacent said upper surface and said side walls, said re-freezable material being configured for freezing while being maintained as an integral portion of said cooler.

5. The cooler of claim 1, wherein said storage chamber is configured to receive a first beverage container and a second beverage container therein, each of the beverage containers having a top end and a bottom end, said storage chamber being configured to receive the beverage containers in a stacked configuration such that the bottom end of the first container engages the top end of the second container.

6. A beverage cooler for transporting and cooling beverage containers, each of the beverage containers having a substantially cylindrical exterior, said cooler comprising:

an outer shell defining an interior and having at least one opening for providing access to said interior, said outer shell being formed of a substantially rigid material for protecting beverage containers stored therein;

means for engaging said opening and encasing said interior;

at least one storage chamber formed within said interior, said storage chamber being configured with a substantially cylindrical shape, said storage chamber adapted to receive at least one beverage container such that said cylindrical shape of said storage chamber substantially conforms to the exterior of a beverage container inserted therein;

an insulating material disposed within said interior between said storage chamber and said outer shell; and a re-freezable material disposed within said interior between said storage chamber and said insulating material such that said re-freezable material is disposed and is configured to conform about the exterior of a beverage container inserted within said storage chamber.

* * * * *